US009412316B2

(12) United States Patent
Ben-David et al.

(10) Patent No.: US 9,412,316 B2
(45) Date of Patent: Aug. 9, 2016

(54) METHOD, DEVICE AND SYSTEM OF DISPLAYING A MORE-THAN-THREE PRIMARY COLOR IMAGE

(75) Inventors: Ilan Ben-David, Rosh Ha'ayin (IL); Nir Weiss, Herzliya (IL)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 2028 days.

(21) Appl. No.: 10/588,755

(22) PCT Filed: Feb. 9, 2005

(86) PCT No.: PCT/IL2005/000161

§ 371 (c)(1),
(2), (4) Date: Aug. 8, 2006

(87) PCT Pub. No.: WO2005/076257

PCT Pub. Date: Aug. 18, 2005

(65) Prior Publication Data

US 2007/0176948 A1 Aug. 2, 2007

Related U.S. Application Data

(60) Provisional application No. 60/542,283, filed on Feb. 9, 2004, provisional application No. 60/549,540, filed on Mar. 4, 2004.

(51) Int. Cl.

| | |
|---|---|
| ***G09G 5/10*** | (2006.01) |
| ***G09G 3/36*** | (2006.01) |
| ***G09G 3/20*** | (2006.01) |

(52) U.S. Cl.

CPC ..... *G09G 3/3607* (2013.01); *G09G 3/2003* (2013.01); *G09G 3/3648* (2013.01);

(Continued)

(58) Field of Classification Search

CPC . G09G 3/3607; G09G 3/2003; G09G 3/3648; G09G 2300/0452; G09G 2320/0233

USPC ..... 345/88, 204, 690, 208, 589, 603, 604; 348/453, 555, 557, 751, 790; 349/106, 349/108

See application file for complete search history.

(56) References Cited

U.S. PATENT DOCUMENTS 5,563,725 A * 10/1996 Kumada et al. ..... 358/518
5,896,178 A * 4/1999 Inoue ..... 348/453

(Continued)

FOREIGN PATENT DOCUMENTS

EP 0 831 451 3/1998
EP 831451 A2 * 3/1998

(Continued)

OTHER PUBLICATIONS

International Search Report for International Application No. PCT/IL05/00161 mailed Jul. 20, 2005.

(Continued)

*Primary Examiner* — Temesgh Ghebretinsae
*Assistant Examiner* — Benyam Ketema
(74) *Attorney, Agent, or Firm* — Pearl Cohen Zedek Latzer Baratz LLP

(57) ABSTRACT

Embodiments of the invention include a method, device and/or system for displaying a more than three primary color (RGB) image. The device (100,200) may include, for example, a driver control module (218) to controllably activate one or more drivers (206,210) of an array of sub-pixel elements of at least four primary colors based on image data representing pixels of the color image in terms of at least three primary colors (RGB). Other embodiments are described and claimed.

22 Claims, 9 Drawing Sheets

(52) U.S. Cl.
CPC ..... *G09G2300/0452* (2013.01); *G09G 2320/0233* (2013.01); *G09G 2320/0242* (2013.01); *G09G 2330/10* (2013.01); *G09G 2340/0457* (2013.01); *G09G 2340/06* (2013.01)

(56) References Cited

U.S. PATENT DOCUMENTS

| | | | | |
|---|---|---|---|---|
| 6,570,584 | B1 * | 5/2003 | Cok et al. | 345/690 |
| 6,897,876 | B2 * | 5/2005 | Murdoch et al. | 345/589 |
| 7,365,722 | B2 * | 4/2008 | Lee | 345/88 |
| 2003/0160915 | A1 | 8/2003 | Liu | |
| 2004/0174389 | A1 * | 9/2004 | Ben-David | G09G 3/3413 345/694 |
| 2006/0066547 | A1 * | 3/2006 | Nitta | G09G 3/006 345/88 |
| 2007/0257866 | A1 * | 11/2007 | Cok | G09G 3/20 345/76 |
| 2008/0143657 | A1 * | 6/2008 | Weiss | G09G 3/3648 345/87 |
| 2009/0179826 | A1 * | 7/2009 | Malka | G09G 3/3607 345/32 |

FOREIGN PATENT DOCUMENTS

| | | | |
|---|---|---|---|
| WO | WO 01/37249 | | 5/2001 |
| WO | WO 0137249 | A2 * | 5/2001 |
| WO | WO 02/099557 | | 12/2002 |
| WO | WO 02/101644 | | 12/2002 |
| WO | WO 02099557 | A2 * | 12/2002 |
| WO | WO 03/088203 | | 10/2003 |
| WO | WO 03088203 | A1 * | 10/2003 |
| WO | WO 2005/057532 | | 6/2005 |
| WO | WO 2005/065027 | | 7/2005 |

OTHER PUBLICATIONS

Supplementary European Search Report for Application No. EP 05 70 3203 mailed Mar. 27, 2008.

Tsai et al., "Color Reproduction of Twist Nematic LCD by Polynomial Regression Applied in Primary-Invariance Model", 1999 SID International Symposium—May 18-20, 1999, San Jose, California, May 18, 1999, pp. 1-4.

Sharma, "LCDs Versus CRTs—Color-Calibration and Gamut Considerations", Proceedings of the IEEE, IEEE, New York, US, vol. 90, No. 4, Apr. 1, 2002, pp. 605-622.

Kwak et al., "Accurate Prediction of Colours on Liquid Crystal Displays", Color Science and Engineering: Systems, Technologies, Applications: Final Program and Proceedings of IS&T and SID Ninth Color Imaging Conference, IS&T, Springfield, VA, US, vol. 9, Nov. 1, 2001, pp. 355-359.

* cited by examiner

| | | | | | | | |
|---|---|---|---|---|---|---|---|
| R | G | Y | B | C | R | G | Y |
| C | R | G | Y | B | C | R | G |
| B | C | R | G | Y | B | C | R |
| Y | B | C | R | G | Y | B | C |
| G | Y | B | C | R | G | Y | B |
| R | G | Y | B | C | R | G | Y |

*FIG. 8*

METHOD, DEVICE AND SYSTEM OF DISPLAYING A MORE-THAN-THREE PRIMARY COLOR IMAGE

CROSS-REFERENCE TO RELATED APPLICATIONS

This application is a National Phase Application of PCT International Application No. PCT/IL2005/000161, International Filing Date Feb. 9, 2005, which claims priority of U.S. Patent Application 60/542,283, filed Feb. 9, 2004, and U.S. Patent Application 60/549,540, filed Mar. 4, 2004, the entire disclosures of all of which are incorporated herein by reference.

FIELD OF THE INVENTION

The invention relates to color display systems generally and, more particularly, to color display systems, e.g., liquid crystal display systems, implementing an array of sub-pixel elements.

BACKGROUND

FIG. 1 schematically illustrates a conventional color Liquid Crystal Display (LCD) system 100. System 100 may include an array 108 of liquid crystal (LC) elements (cells) 104, for example, an LC array using Thin Film Transistor (TFT) active-matrix technology, as is known in the art, and a tri-color filter array, e.g., a RGB filter array 106, which may be juxtaposed with LC array 108. System 100 may also include a first set of electronic circuits ("row drivers") 110 and a second set of electronic circuits ("column drivers") 130 for driving the LC array cells, e.g., by active-matrix addressing, as is known in the art. In existing LCD devices, each full-color pixel of the displayed image is reproduced by three sub-pixels, each sub-pixel corresponding to a different primary color, e.g., each pixel is reproduced by driving a respective set of R, G and B sub-pixels. For each sub-pixel there is a corresponding cell in LC array 108. The transmittance of each of the sub-pixels is controlled by the voltage applied to the corresponding LC cell, based on RGB data input 119 for the corresponding pixel. A timing controller (TCON) 118 receives the input RGB data and adjusts the magnitude of a signal 123 delivered to the different column drivers 130 based on the input data for each pixel. TCON 118 may also provide drivers 110 with a timing signal 121 to controllably activate rows of LC array 108, as is known in the art. The intensity of white light, e.g., provided by a back-illumination source, may be spatially modulated by LC array 108, selectively attenuating the light for each sub pixel according to the desired intensity of the sub-pixel. The selectively attenuated light passes through RGB color filter array 106, wherein each LC cell is in registry with a corresponding color sub-pixel, producing the desired color sub-pixel combinations. The human vision system spatially integrates the light filtered through the different color sub-pixels to perceive a color image.

SUMMARY OF SOME EMBODIMENTS OF THE INVENTION

Embodiments of the invention include devices, systems and/or methods of controllably activating drivers of an array of sub-pixel elements of more-than-three primary colors, e.g., based on an at least three primary color data.

According to some exemplary embodiments of the invention, a color display device for displaying a more-than-three primary color image, may include a driver control module to controllably activate one or more drivers of an array of sub-pixel elements, e.g., liquid crystal elements, of at least four primary colors based on image data representing pixels of the color image in terms of at least three primary colors. The driver control module may be able, for example, to generate one or more driver signals for activating the drivers based on one or more display attributes related to the display device and one or more image attributes related to the color image.

According to some exemplary embodiments of the invention, the driver control module may include a conversion module for converting the image data into converted sub-pixel data representing the color image in terms of four or more primary colors, and a controller to control the conversion module to convert the image data based on the one or more display-attributes and/or the one or more image-attributes. The conversion module may be able to convert the image data, for example, using at least one conversion matrix, which may be based on at least one of the display attributes and image attributes.

According to some exemplary embodiments, the controller may be able to determine one or more values of the conversion matrix based on a combination of the one or more display-attributes and the one or more image-attributes, and/or based on one or more timing signals related to the image data.

According to some exemplary embodiments of the invention, the driver control module may include a sub-pixel processor to process the converted sub-pixel data, wherein the controller is able to control the processor to generate a sub-pixel signal based on at least one of the image attributes and display attributes.

The device may also include an interface module for generating the driver signals based on the sub-pixel data signal. The device may also include a memory to store display-related data representing the one or more display attributes.

According to some exemplary embodiments of the invention, the display device may include a display panel containing both the driver control module and the array of sub-pixel elements.

BRIEF DESCRIPTION OF THE DRAWINGS

The invention will be understood and appreciated more fully from the following detailed description of embodiments of the invention, taken in conjunction with the accompanying drawings of which:

FIG. 8 is a schematic illustration of a super-pixel arrangement in accordance with an exemplary embodiment of the invention.

Figure 1:
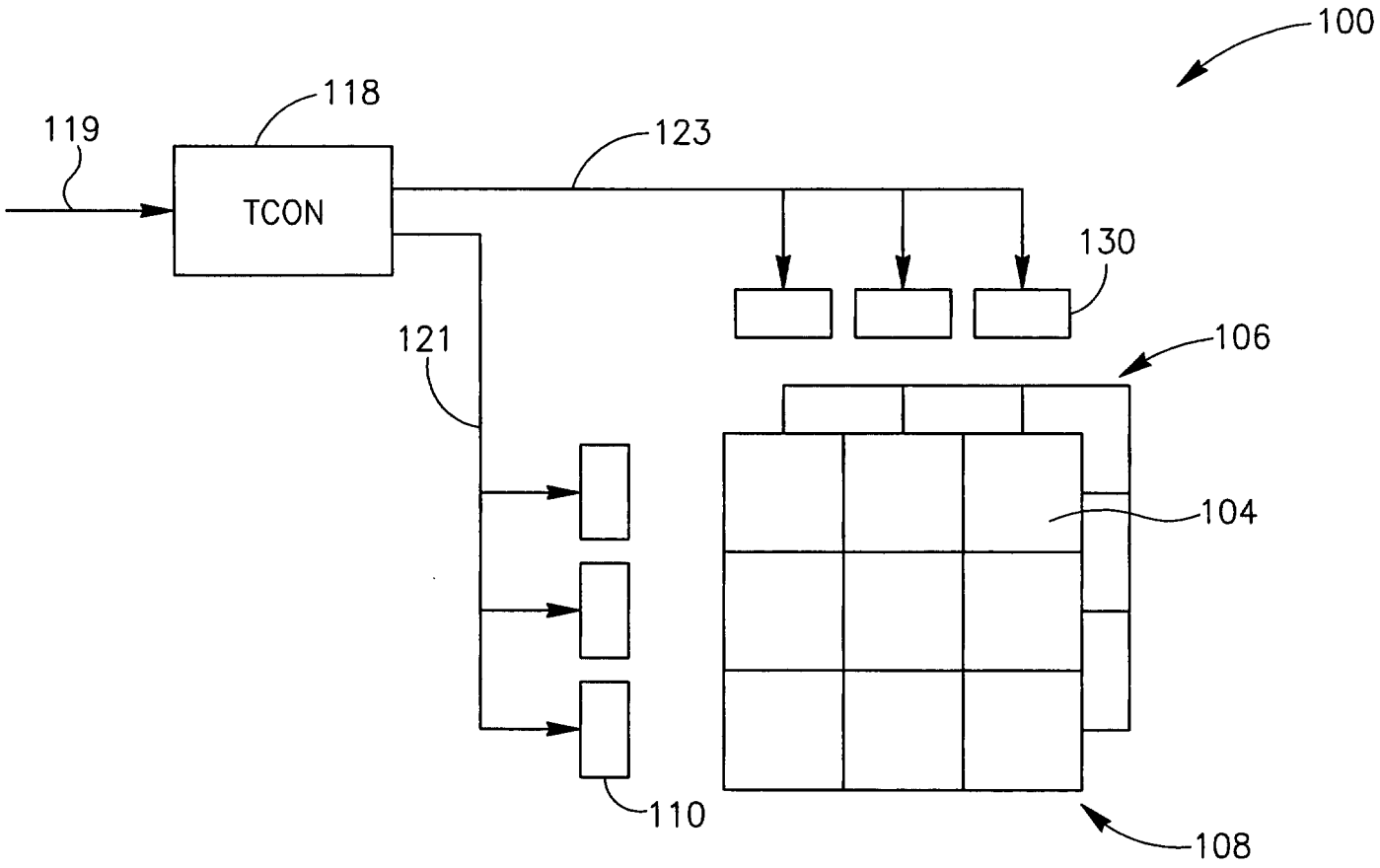
FIG. 1 is a schematic block diagram of a conventional LCD color display system.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF EMBODIMENTS OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details presented herein. Furthermore, some features of the invention relying on principles and implementations known in the art may be omitted or simplified to avoid obscuring the present invention.

Unless specifically stated otherwise, as apparent from the following discussions, it is appreciated that throughout the specification discussions utilizing terms such as "processing", "computing", "calculating", "determining", or the like, refer to the action and/or processes of an electronic circuit or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

Embodiments of the invention include a device, system and/or method of controllably activating drivers of an array of sub-pixel elements of n-primary colors, wherein n is greater than three, e.g., based on an at least three primary color data, as described below.

According to some exemplary embodiments of the invention, the drivers may be controllably activated using one or more driver signals, which may be generated based on one or more display attributes and/or one or more image attributes, as described in detail below.

It will be appreciated that the term "display attributes" as used herein may refer to one or more attributes of a color display device, for example, a configuration of one or more sub-pixel elements within an array of sub-pixel elements of the display, a configuration of one or more defective sub-pixel elements within the array, a brightness and/or color non-homogeneity of the display device, and/or any other objective, subjective or relative attribute, which may be related to the display device.

It will be appreciated that the term "image attributes" as used herein may refer to one or more attributes related to at least part of a displayed color image, or a color image to be displayed, for example, a perceived bit-depth of pixels of at least part of the color image, a viewed smoothness of at least part of the color image, a brightness and/or color uniformity of at least part of the color image, a rendering scheme to be applied to at least part of the color image, and/or any other objective, subjective or relative attribute, which may be related to the color image.

Certain aspects of monitors and display devices with more than three primaries, in accordance with exemplary embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644 ("Reference 1"), and in International Application PCT/IL02/00307, filed Apr. 13, 2003, entitled "COLOR DISPLAY DEVICES AND METHODS WITH ENHANCED ATTRIBUTES" and published 23 Oct. 2003 as PCT Publication WO03/088203 ("Reference 2"), the disclosure of which are incorporated herein by reference.

Figure 2:
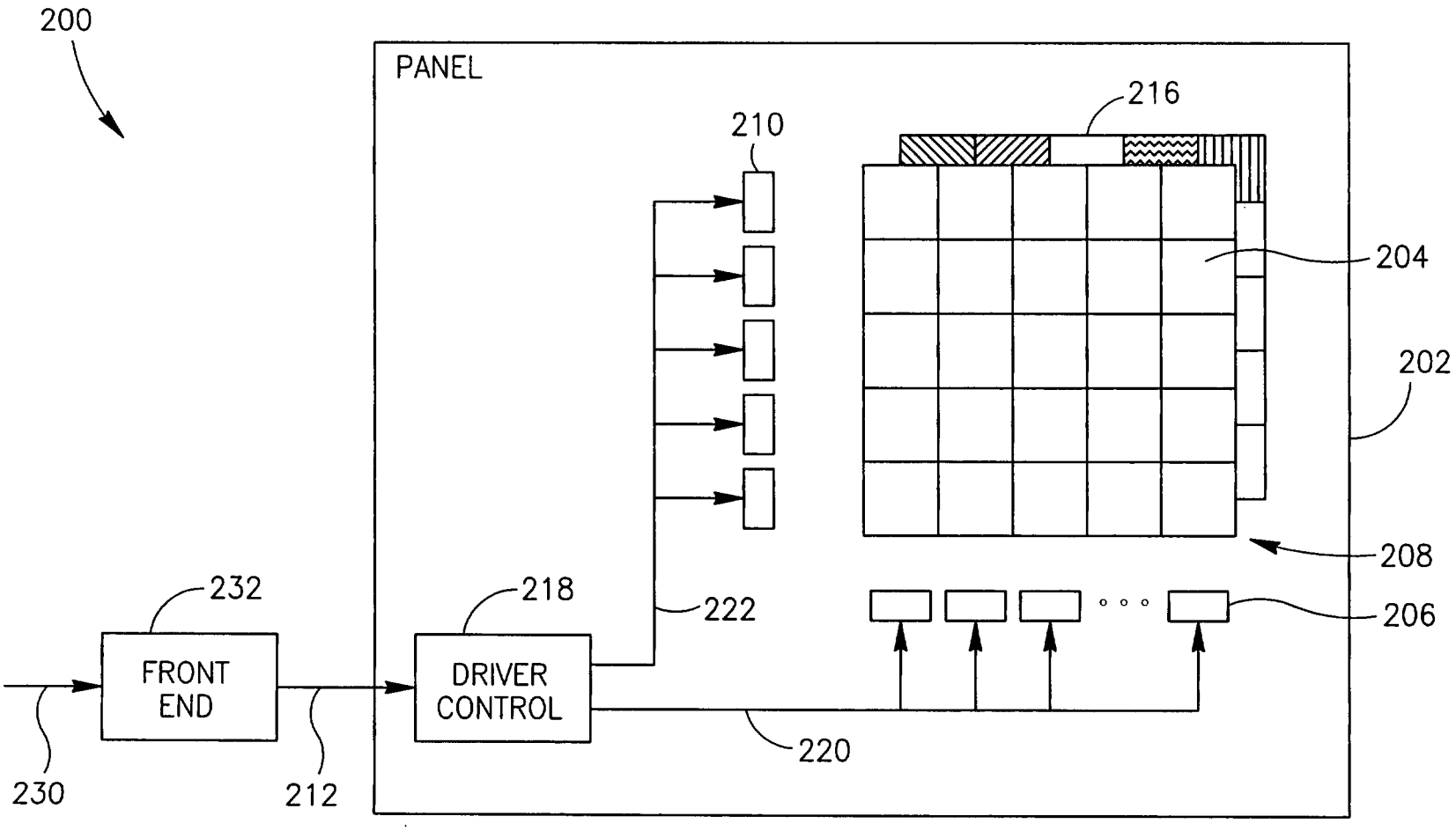
FIG. 2 is a schematic block diagram of a more-than-three primary color display in accordance with exemplary embodiments of the invention.

Reference is made to FIG. 2, which schematically illustrates an n-primary color display system 200 in accordance with exemplary embodiments of the invention.

According to exemplary embodiments of the invention, system 200 may include an n-primary LCD panel 202 to display a color image, e.g., based on a three-primary video input signal 212, as described below.

Some exemplary embodiments of the invention are described herein in relation to activating drivers of an array of Liquid Crystal (LC) elements, e.g., which may be part of a Liquid Crystal Display (LCD) panel. However, it will be appreciated by those skilled in the art, that other embodiments of the invention may be implemented for activating drivers of any other array of sub-pixel elements.

According to exemplary embodiments of the invention, panel 202 may include an array 208 of sub-pixel elements, e.g., LC elements (cells) 204, for example, an LC array using Thin Film Transistor (TFT) active-matrix technology, as is known in the art. For example, each of cells 204 may be connected to a horizontal ("row") line (not shown) and a vertical ("column") line (not shown), as are known in the art.

Panel 202 may also include a first set of electronic circuits 210 ("row drivers") associated with the row lines, and a second set of electronic circuits 206 ("column drivers") associated with the column lines. Drivers 210 and 206 may be implemented for driving the cells of array 208, e.g., by active-matrix addressing, as is known in the art. Panel 202 may also include an n-primary-color filter array 216, which may be, for example, juxtaposed to array 208. Panel 202 may include any other suitable configuration of sub-pixel elements. In LCD devices according to some exemplary embodiments of the invention, a full-color pixel of the displayed image may be reproduced by more than three sub-pixels, each sub-pixel corresponding to a different primary color, e.g., a pixel may be reproduced by driving a corresponding set of four or more sub-pixels. For each of the four or more sub-pixel there may be a corresponding cell in LC array 208, and each LC cell may be associated with a color filter element in color filter array 216 corresponding to one of four or more, respective, primary colors. A back-illumination source (not shown) may provide light needed to produce the color images. The transmittance of one or more of the sub-pixels may be controlled by controlling a voltage applied, e.g., using column drivers 206, across a corresponding LC cell of array 208, as described below.

According to some exemplary embodiments of the invention, panel 202 may include s column drivers 206, each adapted to control q=n*r/s columns of array 208, wherein r is, for example, the number of pixels per row of the display. For example, if r=1280 pixels and n=6 primary colors, then panel 202 may include 10 column drivers 206, each to control, e.g., q=6*1280/10=768 columns of array 208. According to other embodiments of the invention, panel 202 may include any other suitable configuration of row and/or column drivers.

According to exemplary embodiments of the invention, panel 202 may also include an n-primaries driver control module 218 to controllably activate drivers 206 and/or 210, e.g., by providing drivers 206 with control and/or data signals 220, and/or drivers 210 with control signals 222, for example, based on the image data, e.g., of signal 212, as described in detail below.

According to some exemplary embodiments of the invention, driver control module 218 may be able to generate signals 220 and/or 222 based on one or more display attributes related to system 200, and/or one or more image attributes related to the color image, as described below. The display attributes may include, for example, a configuration of cells 204 within array 208, a configuration of one or more defective sub-pixel elements within array 208, a brightness and/or color non-homogeneity of system 200, and/or any other attribute related to system 200, e.g., as described below. The image attributes may include, for example, a perceived bit-depth of pixels of at least part of the color image, a viewed smoothness of at least part of the color image, a rendering scheme to be applied to at least part of the color image, and/or any other attribute related to at least part of the color image, e.g., as described below.

The intensity of white light provided by the back-illumination source may be spatially modulated by elements 204 of LC array 208, thereby selectively controlling the illumination of each sub-pixel according to image data for the sub-pixel. The selectively attenuated light of each sub-pixel may pass through the corresponding color filter of color filter array 216, thereby producing desired color sub-pixel combinations. The human vision system may spatially integrate the light filtered through the different color sub-pixels to perceive a color image.

According to exemplary embodiments of the invention, system 200 may also include a front-end module 232. Module 232 may include, for example, an analog-to-digital ("A/D") converter to convert an analog video input signal 230 into digital video input signal 212, as is known in the art. According to other exemplary embodiments signal 230 may include a digital video input signal and module 232 may not include the A/D converter.

Module 232 may optionally include a user interface (not shown), e.g., a keyboard, a mouse, and/or any type of user-interface as is known in the art. Module 232 may include any other software and/or hardware, e.g., as are known in the art.

Aspects of the invention are described herein in the context of an exemplary display system, wherein a driver control module, e.g., driver control module 218, is included within a panel unit, e.g., LCD panel 202. Although this embodiment is suitable for many commercial applications of the invention, it will be appreciated by those skilled in the art that, according to other embodiments of the invention, the driver control module and the LCD panel, e.g., including the array sub-pixel elements, may be implemented as two separate units. For example, in some embodiments, the driver control module may be implemented as part of a front-end module, e.g., module 232.

Aspects of the invention are described herein in the context of an exemplary embodiment of a driver control module, e.g., driver control module 218, and drivers, e.g., drivers 206 and 210, being separate units of a panel, e.g., panel 202. However, it will be appreciated by those skilled in the art that, according to other embodiments of the invention, the driver control module may include at least some of the drivers, e.g., as described below.

Figure 3:
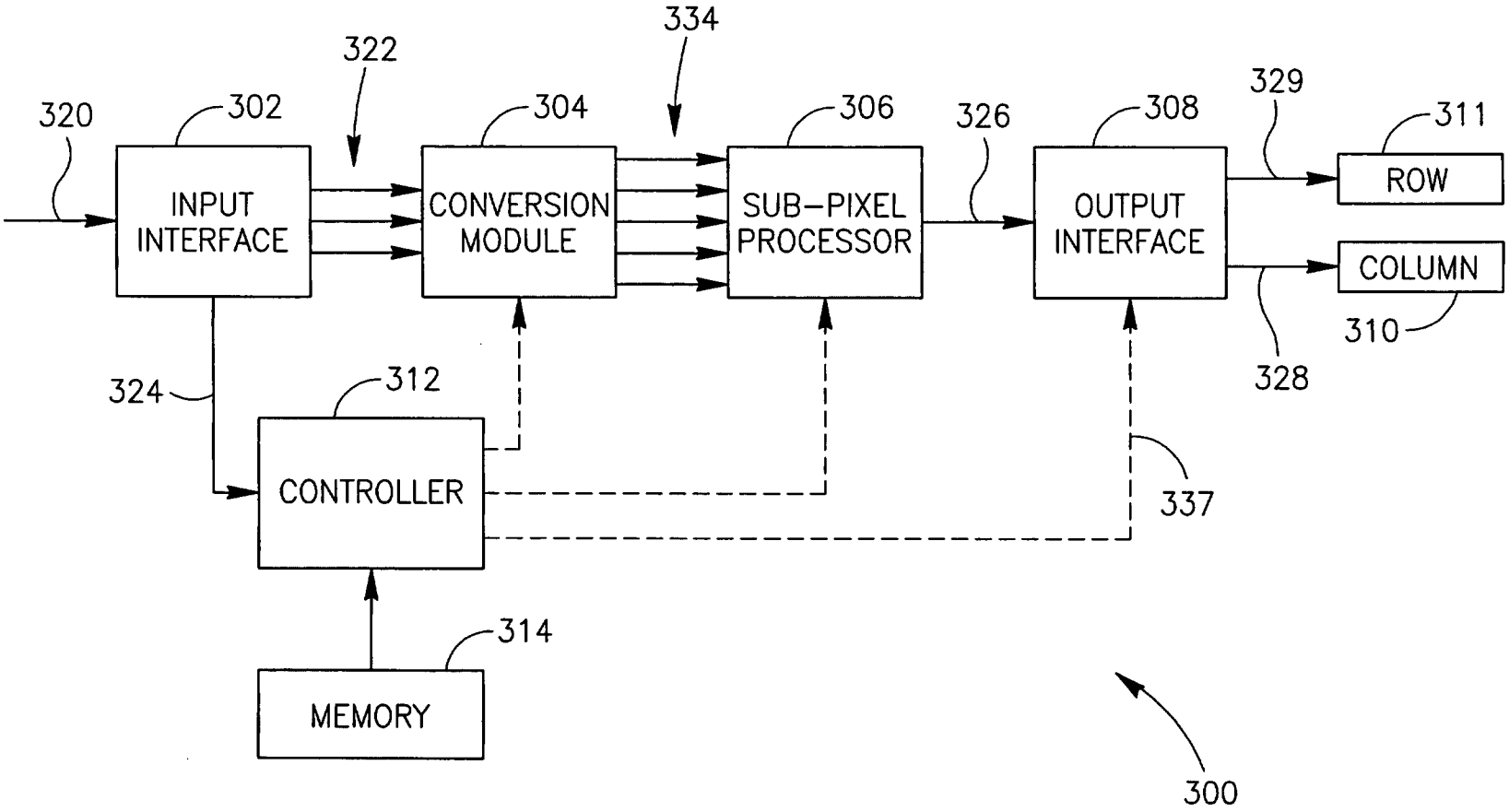
FIG. 3 is a schematic block diagram of a driver control module in accordance with exemplary embodiments of the invention.

Reference is made to FIG. 3, which schematically illustrates a driver control module 300 according to exemplary embodiments of the invention.

Although the invention is not limited in this respect, module 300 may perform the functionality of driver control module 218 (FIG. 2).

According to exemplary embodiments of the invention, module 300 may include an input interface module 302 to receive, e.g., from front end module 232 (FIG. 2), a digital video input 320 and provide an output including a set of, e.g., parallel, three-primary pixel data signals 322 and one or more video control signals 324. For example, input 320 may include a three-primary, e.g., RGB or YCC, video signal, having a predetermined video interface, e.g., a Digital Video Interface (DVI) or a Low Voltage Differential Signaling (LVDS) interface, as are known in the art. Three-primary pixel data signals 322 may include, for example, three parallel, e.g., 8-bit, or 10-bit, primary color data signals, as is known in the art. Signals 324 may include any timing and/or control signals, e.g., including a Data Enable (DE) signal, a horizontal synchronize (Hsync) signal, a vertical synchronize (Vsync) signal and/or a clock signal, as are known in the art. For example, input interface module 302 may include, for example, an input interface module similar to the PanelLink® receiver available from Silicon Image of California, USA, or any other suitable interface module.

According to exemplary embodiments of the invention, module 300 may include a conversion module 304 to convert the image data of signals 322 into sub-pixel data representing the image in terms of at least four primary colors. For example, module 304 may convert pixel data signals 322 into a corresponding set of n-primary pixel data signals 334, which may include, for example, n primary color signals, each representing a sub-pixel attenuation level on a desired bit-depth, e.g., 8-bit, 10-bit or any other suitable bit-depth, as described below.

Module 300 may further include a sub-pixel processor module 306 to process at least some of signals 334 and provide a sub-pixel data signal 326, e.g., an 8-bit or 10-bit signal, corresponding, for example, to a predetermined sub-pixel arrangement of a LCD panel, e.g., panel 202 (FIG. 2), as described below.

According to exemplary embodiments of the invention, module 300 may also include an output interface 308. Output interface 308 may include any suitable circuitry for generating, based one signal 326, one or more column driver signals 328 and/or one more row driver signals 329 of an interface technology, e.g., a Reduced Swing Differential Signaling (RSDS) interface, as is known in the art, adapted to activate one or more column drivers 310 and/or one or more row drivers 311, respectively.

According to exemplary embodiments of the invention, module 300 may further include a controller 312 to control conversion module 304, sub-pixel processing module 306 and/or output interface 308, e.g., based on values of one or more of signals 324 and/or at least one of the display attributes and/or image attributes, as described below. Controller 312 may include any suitable hardware and/or software. Controller 312 may control output interface 308 using, for example, a timing control signal 337, e.g., as is known in the art.

According to exemplary embodiments of the invention, module 300 may further include a memory 314, to store, for example, display related data representing attribute values corresponding to LC panel 202, as described below. According to other embodiments, memory 314 may be implemented separately from module 300, e.g., as part of panel 202 (FIG. 2) or front end 232 (FIG. 2).

According to some exemplary embodiments of the invention, module 300 may be implemented as an integrated circuit, e.g., including interface 302, conversion module 304, processor module 306, interface 308, controller 312 and memory 314. However, it will be appreciated that according to other embodiments, one or more of interface 302, conversion module 304, processor module 306, interface 308, controller 312 and memory 314 may be implemented as separate elements.

Figure 4:
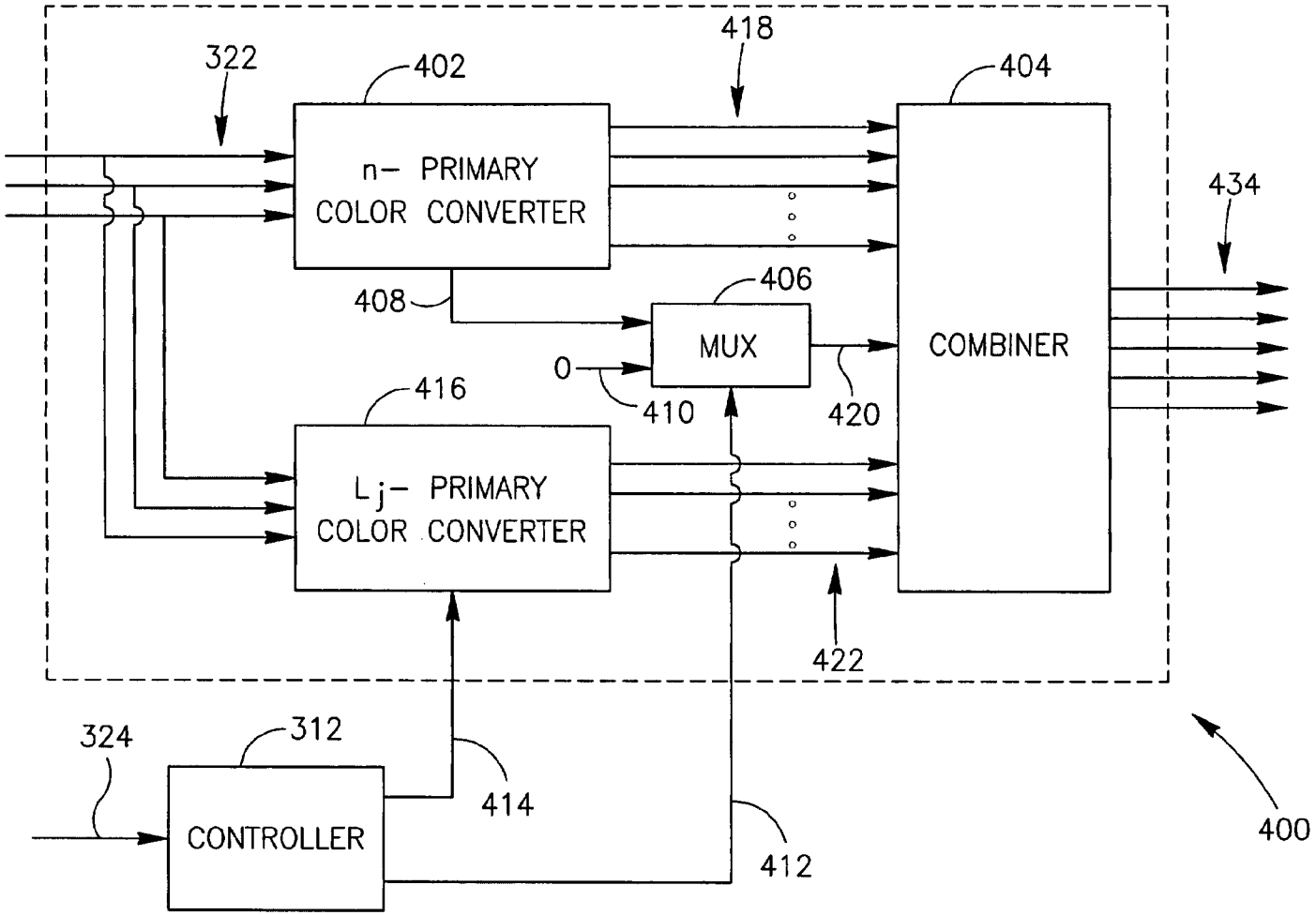
FIG. 4 is a schematic block diagram of a conversion module in accordance with one exemplary embodiment of the invention.

Reference is made to FIG. 4, which schematically illustrates a conversion module 400, according to one exemplary embodiment of the invention.

Although the invention is not limited in this respect, module 400 may perform the functionality of conversion module 304 (FIG. 3).

According to some exemplary embodiments, conversion module 400 may include an n-primary color converter 402 for converting three-primary pixel data of signals 322, into first intermediate sub-pixel data, e.g., n-primary pixel data signals 418. Certain aspects of methods and devices for converting image data in three-primary video formats into a at-least-three-primary format, in accordance with exemplary embodiments of the invention, are described in International Application PCT/IL02/00410, filed May 23, 2002, entitled "DEVICE, SYSTEM AND METHOD OF DATA CONVERSION FOR WIDE GAMUT DISPLAYS" and published 12 Dec. 2002 as PCT Publication WO 02/099557 ("Reference 3"), the disclosure of which is incorporated herein by reference.

According to some exemplary embodiments of the invention, conversion module 400 may also be able to manipulate at least some of signals 322 and/or signals 418, for example, in accordance with a perceived bit-depth enhancement method and/or a defect pixel correction method, e.g., as described below.

According to some exemplary embodiments of the invention, an effective color gamut may be reproduced by a first group of sub-pixels of a smaller number of primary colors, e.g., three primary colors, compared to a second group of sub-pixels, e.g., of between three and six primary colors, as described in Reference 2. This may allow, for example, enhancing a perceived bit-depth of at least some pixels of the displayed image and/or performing defect sub-pixel correction.

According to embodiments of the invention, an n-primary display system, e.g., system 200 (FIG. 2), may be able to substantially reproduce a pixel of a desired color, or a color spectrally similar to the desired color, using only at least some of the n primaries, as described below.

Figure 5:
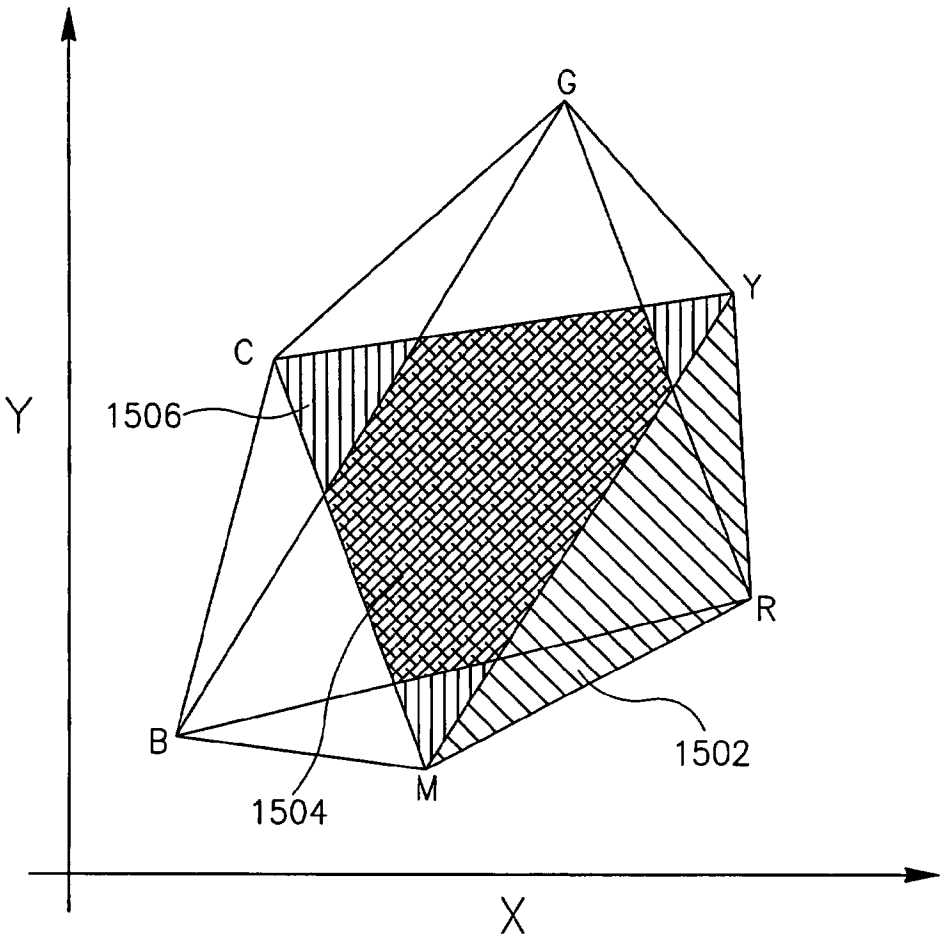
FIG. 5 is a schematic illustration of a chromaticity diagram representing the color gamut of a six-primary display in accordance with an exemplary embodiment of the invention.

Reference is made to FIG. 5, which schematically illustrates a chromaticity diagram representing the color gamut of a 6-primary, e.g., red (R), green (G), blue (B), cyan (C), yellow (Y) and magenta (M), display in accordance with an exemplary embodiment of the invention.

For the six primary colors illustrated in FIG. 5, a selection of a triad of primary colors may define an effective color gamut, e.g., effective color gamut 1502 may be defined by a YMR triad. According to some embodiments of the invention, in order to reproduce a pixel within a desired color gamut, a group, e.g., a triad, of primary colors may be selected such that an effective color gamut defined by the selected triad may substantially reproduce the desired color gamut, as explained in detail in Reference 2. An effective color gamut may be defined by different color triads, e.g., effective color gamut 1504 may be defined by triads RGB and YCM. Selection of a group, e.g., triad, of primary colors from a set of available groups, e.g., triads, defining a required effective color gamut may include optimization of image display attributes, for example, brightness and/or color uniformity, smoothness, or any other objective, subjective or relative attribute.

According to some exemplary embodiments of the invention, a pixel of a desired color within a given color gamut may be reproduced using only $l<n$ of the n sub-pixels, assuming that the effective color gamut defined by the l sub-pixels includes, i.e., is capable of reproducing, the desired color. For example, a pixel having a color included in field 1502 may be reproduced using only the Y, R and M sub-pixels, e.g., without using the G, C and B sub-pixels.

According to some exemplary embodiments of the invention, if the effective color gamut defined by the l sub-pixels does not include, i.e., is not capable of reproducing, the desired color, then a color which is similar to the desired color, or as similar as possible to the desired color, may be reproduced using the l sub-pixels. Additionally or alternatively, a desired color of a pixel may be reproduced by adjusting values of one or more sub-pixels of neighboring pixels. As a result of this adjustment, the adjusted neighboring pixels and/or sub-pixels may be spatially integrated by a viewer to substantially reproduce the desired color.

A selection of a larger number of primary colors, e.g., four or five primary colors, may result in a wider effective color gamut. For example, an effective color gamut including fields 1502, 1504 and field 1506 may be obtained by selecting four primary colors, e.g., C, M, R and Y. Accordingly, the larger the number n of primary colors used by the display, the larger the color gamut that may be reproduced using only some of the sub-pixels.

The ability to reproduce a pixel of a desired color using only some of the n sub-pixels may be advantageous for perceived bit-depth enhancement, e.g., by utilizing the ability to reproduce substantially the same perceived chromaticity using only some of the n sub-pixels, to enable reproducing a larger number of perceived brightness levels, as described in detail in Reference 2; and/or for defective pixel correction, e.g., as described below.

A defective pixel may include one or more defective sub-pixels. The defective sub-pixels may include either sub-pixels constantly being in an "open", i.e., un-attenuated, state and/or sub-pixels constantly being in a "closed", i.e., fully attenuated, state.

According to exemplary embodiments of the invention, information regarding defective pixels of a display, e.g., including a location of one or more defective pixels and/or the identity of one or more defective primary color sub-pixels in the defective pixel, may be recorded, for example, during a testing procedure applied to the display. The testing procedure may include any testing procedure suitable for detecting defective sub-pixels of the display. For example, the testing procedure may include a testing procedure as described in Noam Cohen, "*Automated Optical Inspection for the LTPS TFT-LCD Process*", http://www.orbotech.com/tech_lib_fpd.asp?sub=aoi_ltps_tft. The information obtained by such a testing procedure may be subsequently used in order to enable a defective pixel to reproduce a desired color based on input pixel data, e.g., three-primary or more-than three-primary data, as described below.

According to exemplary embodiments of the invention, a set of i defective pixel types may be defined, based on the defective pixel information. For example, in a six-primary GCBMRY display, a first defective pixel type may correspond to a pixel including a defective R sub-pixel, a second defective pixel type may correspond to a pixel including a defective G sub-pixel, a third defective pixel type may correspond to a pixel including a defective C sub-pixel, a fourth defective pixel type may correspond to a pixel including a defective B sub-pixel, a fifth defective pixel type may correspond to a pixel including a defective Y sub-pixel, and a sixth defective pixel type may correspond to a pixel including a defective M sub-pixel. Other defective pixel types may also be defined, e.g., defective pixel types corresponding to a pixel including more than one defective sub-pixels.

According to exemplary embodiments of the invention, a set of j color conversions may be determined for converting input pixel data into $l_j$-primary pixel data, wherein $l_j$ denotes a predetermined number of primaries. The color conversions may correspond to the defective pixel types, and/or to perceived bit-depth enhancement of a pixel, e.g., as described in detail in Reference 2. For example, a color conversion for converting RGB pixel data into RGCBY pixel data may correspond to the sixth defective pixel type and/or to a perceived bit-depth enhancement of a pixel having a color gamut reproducible by the RGCBY primaries. A color conversion for converting RGB pixel data into RGCB pixel data may correspond to a pixel including defective M and Y sub-pixels and/or to a perceived bit depth enhancement of a pixel having a color gamut reproducible by the RGCB primaries.

Aspects of methods and systems for conversion of image data in three-primary formats into an at-least-three-primary format, in accordance with exemplary embodiments of the invention, are described in Reference 3. According to other embodiments of the invention, any other suitable conversion algorithm, e.g., a conversion algorithm using a $3\times l_j$ color conversion matrix, may be implemented for converting image data in three-primary formats into a $l_j$-primary format.

Thus, according to some exemplary embodiments of the invention, pixel data, e.g., three-primary pixel data, intended to be reproduced by a defective pixel may be converted, e.g., as described in Reference 3, into converted pixel data using a color conversion method suitable for the type of defect of the defective pixel. Pixel data, e.g., three-primary pixel data, intended to be reproduced by a "benign", i.e., non-defective pixel, may be converted, for example, into converted pixel data using a perceived bit-depth enhancement color conversion method, e.g., as described in Reference 2.

Referring back to FIG. 4, according to some exemplary embodiments, conversion module 400 may also include a second converter 416 able to convert the image data into second intermediate sub-pixel data representing the image in terms of at least three primary colors. For example, converter 416 may be able to convert the image data of signals 322 into corresponding $l_j$-primary pixel data signals 422. For example, converter 416 may include a converter, e.g., analogous to the converter described in Reference 3, for converting the pixel data of signals 322 into at-least-three-primary data.

According to some exemplary embodiments of the invention, controller 312 may be able to determine, e.g., based on one or more of signals 324, a pixel of the display intended to reproduce the pixel data of signals 322. For example, controller 312 may include a counter to count the number of Hsync and/or clock signals. Based on the number of Hsync and/or clock signals, controller may be able to determine the identity and/or location of the pixel intended to reproduce the pixel data of signals 322. Controller 312 may also be able to determine whether the pixel intended to reproduce the pixel data of signals 322 is a defective pixel or a "benign" pixel. For example, controller 312 may compare the determined position of the pixel with pre-obtained defective pixel information, which may be stored in memory 314. The defective pixel information may also include, for example, the type of the defective pixel. The defective pixel information may further include parameters, e.g., a color conversion matrix, of an $l_j$-primary conversion related to the defective pixel. Alternatively, controller 312 may be able to select the parameters of the $l_j$-primary conversion, e.g., based on the defective pixel type.

According to exemplary embodiments of the invention, controller 312 may select an $l_j$-primary color conversion related to the type of the defective pixel, as described above, e.g., if the pixel intended to reproduce the pixel data of signals 322 is a defective pixel. Controller 312 may select an $l_j$-primary color conversion corresponding to a perceived bit-depth enhancement of the pixel, as described in Reference 2, e.g., if the pixel intended to reproduce the pixel data of signals 322 is a benign pixel. Controller 312 may provide the parameters of the selected $l_j$-primary conversion to converter 416.

According to exemplary embodiments of the invention, n-primary conversion module 402 may also provide an initial combination parameter signal 408 corresponding to the pixel data of signals 322, which may be used as part of the perceived bit-depth enhancement, e.g., as described in Reference 2. Conversion module 400 may also include a multiplexer 406 to receive signal 408 and produce a selected combination-parameter signal 420, for example, having either a zero value or the value of signal 408, e.g., according to a control signal 412, which may be provided by controller 312. Conversion module 400 may also include a combiner 404 able to combine signals 418 and signals 422 into a set of n-primary pixel data signals 434, e.g., based on the value of signal 420, as described below. For example, signals 434 may include n, e.g., parallel, primary color signals.

According to exemplary embodiments of the invention, controller 312 may control multiplexer 406, e.g., using signal 412, to provide signal 420 having a zero value, e.g., if the pixel data of signals 322 is intended to be reproduced by a defective pixel. As a result, n-primary pixel data signals 434 may include only pixel data of signals 422. Controller 312 may control multiplexer 406, e.g., using signal 412, to provide signal 420 having the value of signal 408, e.g., if the pixel data of signals 322 is intended to be reproduced by a benign pixel. As a result, n-primary pixel data signals 434 may include, for example, a combination of n-primary pixel data of signals 418 and $l_j$-primary pixel data of signals 422.

Thus, signals 434 may include enhanced bit-depth pixel data, e.g., if the pixel data of signals 322 is intended to be reproduced by a benign pixel; or defect-corrected pixel data, e.g., if the pixel data of signals 322 is intended to be reproduced by a defective pixel.

Figure 6:
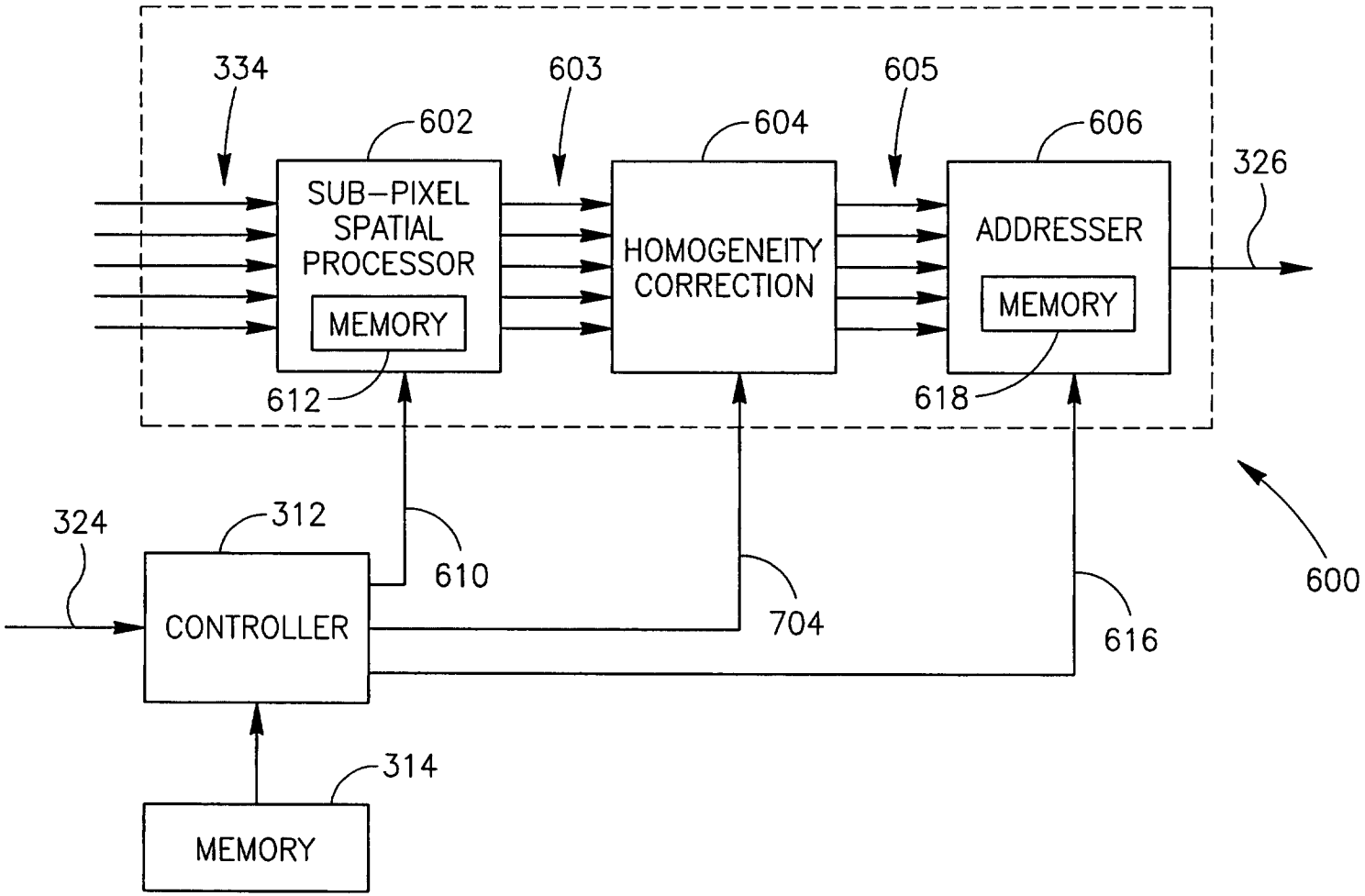
FIG. 6 is schematic block-diagram of a sub-pixel processor module in accordance with exemplary embodiments of the invention.

Reference is made to FIG. 6, which schematically illustrates a sub-pixel processor module 600 according to exemplary embodiments of the invention.

Although the invention is not limited in this respect, module 600 may perform the functionality of sub-pixel processor module 306 (FIG. 3).

According to exemplary embodiments of the invention, module 600 may include a sub-pixel spatial processing module 602 able to process n-primary pixel data signals 334 of one or more pixels and to provide spatially processed data signals 603, e.g., according to a control and/or timing signal 610 received from controller 312. Processing module 602 may implement any suitable sub-pixel spatial processing and/or rendering algorithm, e.g., for spatial scaling, rendering and/or filtering n-primary pixel data of signals 334, e.g., as described in Reference 1 and/or Reference 2. Processing module 602 may include a memory 612 to store data corresponding to one or more pixels, which may be used, for example, as part of at least some of the spatial processing algorithms.

According to exemplary embodiments of the invention, module 600 may optionally include a homogeneity correction module 604, as described in detail below.

According to some exemplary embodiments, the back-illumination source of system 200 (FIG. 2) may include a plurality of fluorescent lamps, or any other suitable white light source, the light of which may pass through one or more homogenizers, e.g., as are known in the art. Such configuration may result in an undesirable variation of viewed brightness and/or color across the display. In order to minimize this non-homogeneity, it may be desired to maintain a relatively fixed ratio between the brightness values of the different primaries across the display.

A variation of the brightness values of each of the primaries across the display may be determined, e.g., during a testing process, and based on the brightness variation, a set of position-dependent homogeneity correction factors corresponding to each of the primary colors may be calculated. For example, each of the homogeneity correction factors may correspond to one of the primaries and a position on the display. Data representing the position-dependent homogeneity correction factors corresponding to each of the primary colors may be stored, for example, in memory 314. The homogeneity correction factor data may be subsequently used in order to correct a brightness variation across the display, as described below. According to other embodiments of the invention, the brightness variation may be determined using any other method, e.g., during operation of the display device.

According to exemplary embodiments of the invention, homogeneity correction module 604 may be able to multiply a value of each one of signals 603 by a respective homogeneity correction factor to produce homogeneity-corrected pixel data signals 605, as described below.

Figure 7:
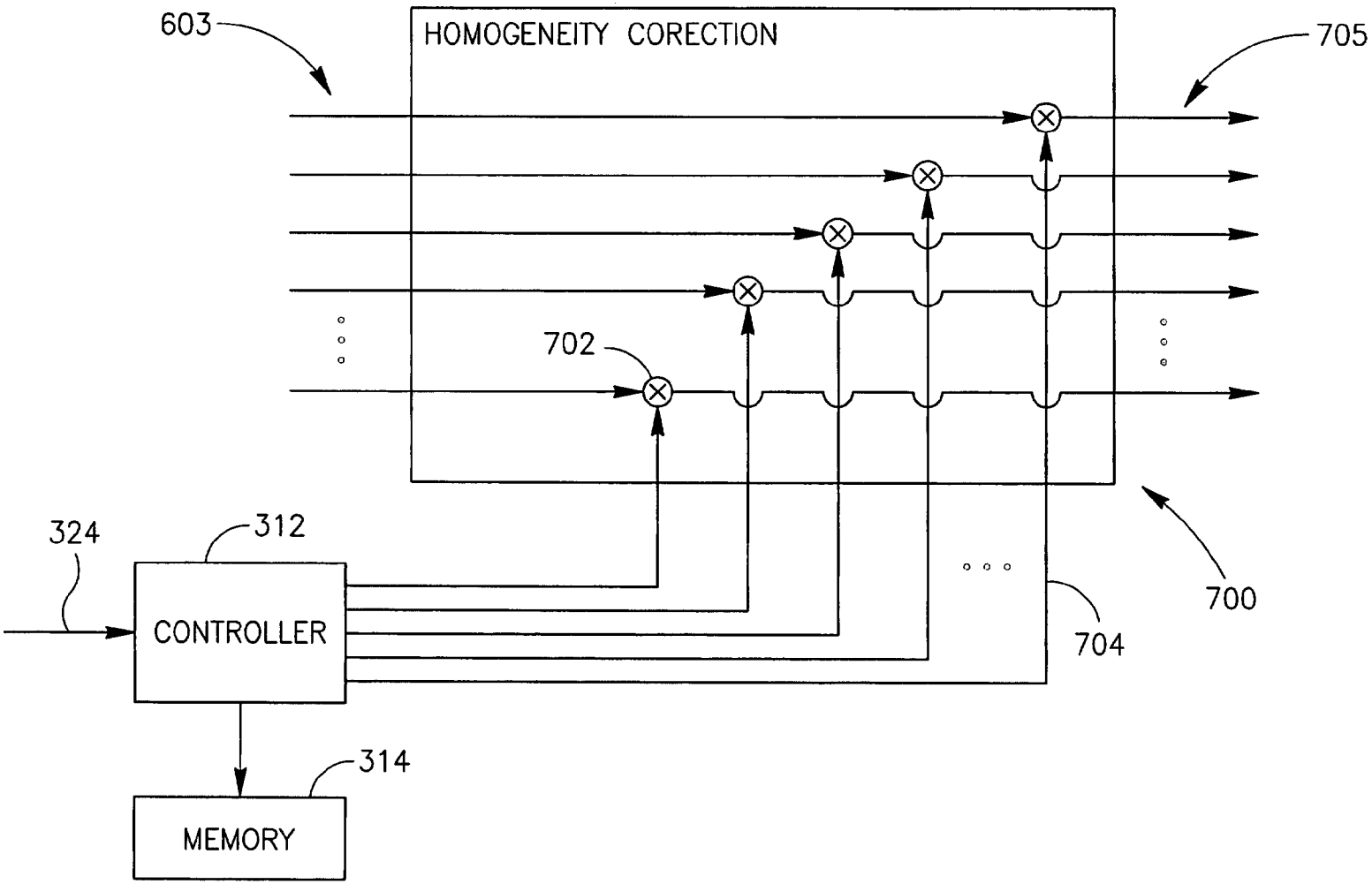
FIG. 7 is a schematic block-diagram of a homogeneity correction module in accordance with exemplary embodiments of the invention.

Reference is made to FIG. 7, which schematically illustrates a homogeneity correction module 700 according to exemplary embodiments of the invention.

Although the invention is not limited in this respect, module 700 may perform the functionality of homogeneity correction module 604 (FIG. 6).

According to exemplary embodiments of the invention, controller 312 may determine, e.g., based on one or more of signals 324, a position of a pixel of the display intended to reproduce the pixel data of signals 603, e.g., as described above with reference to FIG. 4. Controller 312 may then retrieve from memory 314 a set of, e.g., n, homogeneity correction factors corresponding to the determined pixel position, and provide module 700 with a set of, e.g., n, signals 704 having the value of the retrieved set of, e.g., n, correction factors, respectively.

Module 700 may include a set of, e.g., n, multipliers 702 to provide a set of, e.g., n, signals 705 having values corresponding to a multiplication of the values of the set of signals 603 by correction factor values of set of signals 704, respectively.

According to some exemplary embodiments of the invention, the homogeneity correction factor values may be stored in memory 314 at a reduced resolution, e.g., including only some of the homogeneity correction factor values. Homogeneity correction factor values not stored in memory 314 may be calculated, e.g., by controller 312, using a suitable interpolation method.

Referring back to FIG. 6, according to exemplary embodiments of the invention, sub-pixel processor module 600 may also include an addresser 606 to process pixel data 605 and provide sub-pixel data signal 326 including sub-pixel data in an order corresponding to a predetermined sub-pixel arrangement of panel 202 (FIG. 2), as described in detail below.

According to exemplary embodiments of the invention, array 208 (FIG. 2) may include a predetermined sub-pixel arrangement, e.g., as described in Reference 1 or Reference 2. For example, panel array 208 (FIG. 2) may include a super-pixel arrangement including a predetermined, fixed, number of n-primary pixels, each n-primary pixel including one color sub-pixel element of each of the n primary colors, as described in detail in Reference 1.

According to exemplary embodiments of the invention, addresser 606 may receive n-primary signals 605 and arrange them in an order corresponding to a physical sub-pixel order, e.g., within the rows of LC array 208 (FIG. 2), such that drivers 210 and/or 206 (FIG. 2) may activate respective sub-pixels of LC array 208 (FIG. 2) in accordance with the data of signal 212 (FIG. 2).

Reference is also made to FIG. 8, which schematically illustrates a super-pixel arrangement 800 according to an exemplary embodiment of the invention.

According to the exemplary embodiment of FIG. 8, if the drivers activate the sub-pixels of each row of array 204 (FIG. 2) sequentially, then addresser 606 may receive n-primary data signals 605 corresponding to all the pixels within super-pixel 800 and may address the sub-pixel values to the corresponding physical sub-pixel, e.g., according to the following order: "RGYB" in the first row, "CRGY" in the second row, "BCRG" in the third row, etc. Addresser 606 may include any suitable hardware and/or software, e.g., as described in detail in Reference 1. Addresser 606 may also include a memory 618 for storing pixel data of one or more of the n-primary pixels corresponding to the super pixel, e.g., data of sub-pixels to be displayed in subsequent rows.

In other exemplary embodiments, the arrangement of sub-pixels may include a spatially periodic pattern including a smaller number of sub-pixels corresponding to one or more predetermined primary colors, e.g., blue and cyan, compared to the number of sub-pixels corresponding to other primary colors, e.g., as described in International Application PCT/IL2004/001123 filed Dec. 13, 2004 and entitled "MULTI-PRIMARY LIQUID CRYSTAL DISPLAY", the disclosure of which is incorporated herein by reference. In such embodiments, addresser 606 may be able to process the n-primary data signals 605 corresponding to two or more neighboring pixels and provide signal 326 including a smaller number of, e.g., blue and cyan, sub-pixel values compared to the number of sub-pixel values corresponding to other primary colors. For example, addresser 606 may be able to calculate a weighted average of two or more sub-pixel values of two or more neighboring pixels intended to be displayed by one sub-pixel, e.g., a blue or cyan sub-pixel, of the display.

According to some exemplary embodiments of the invention, addresser 606 may also implement, for example, one or more sub-pixel correction methods for correcting a vertical and/or horizontal shift of an effective (color-weighted) center of the n-primary pixel, as described in Reference 1. This may be achieved, for example, by performing an interpolation between values of one or more sub-pixels of a pixel and/or of neighboring pixels. The interpolation may be linear, cubic or of any other suitable form, as described in References 1 and/or 2. Addresser 606 may also be able to perform a "smoothing" (low-pass filtering) operation, for example, in order to reduce a color fringes effect of a displayed graphic object, e.g., a character of a certain font. According to this exemplary embodiment, the value of at least some of the sub-pixels may be affected by more than one pixel, and a weighted average function may be applied by addresser 606 in order, for example, to reduce the color fringes effect. Memory 618 may be used to store sub-pixel values of one or more pixels neighboring the pixel to be displayed. Memory 618 may also be used to store pixel data corresponding to one or more rows of the display, e.g., if processing pixel data of one or more rows is required, e.g., as described in References 1 and/or 2.

Although according to some of the embodiments, the processing methods described above may be performed by addresser 606 on signals 605, according to other embodiments some of the processing methods may be performed on signals 603 and/or 334. For example, processor 602 may be adapted to process signals 334 according to at least some of the processing and/or sub-pixel rendering methods described above with reference to addresser 606.

According to some exemplary embodiments of the invention, drivers 310 (FIG. 3) and/or drivers 311 (FIG. 3) may be integrated as part of driver control module 218 (FIG. 2), and the format of the control and/or timing signals provided to drivers 310 and/or 311 may be preset. According to these embodiments, addresser 606 may be adapted to directly provide drivers 311 and/or drivers 310 with control and/or timing signals in the preset format, e.g., signals 329 and/or 328, obviating the need for output interface 308 (FIG. 3).

Some exemplary embodiments of the invention described above, relate to a driver control module, e.g., module 300 (FIG. 3), including a conversion module, e.g., module 400 (FIG. 4), able to convert the image data into sub-pixel data in terms of at least four primary colors, e.g., including applying defect pixel correction methods and/or perceived bit-depth enhancement methods; and a sub-pixel processor module, e.g., module 600 (FIG. 6), able to process the converted sub-pixel data using sub-pixel processing and/or rendering methods, e.g., homogeneity correction methods. However, it will be appreciated by those skilled in the art that according to other embodiments of the invention, the driver control module may include a conversion module able to apply to the image data one or more of the processing and/or rendering methods, in addition to or instead of, the processing and/or rendering methods applied by the sub-pixel processing module to the sub-pixel data, e.g., as described below.

Figure 9:
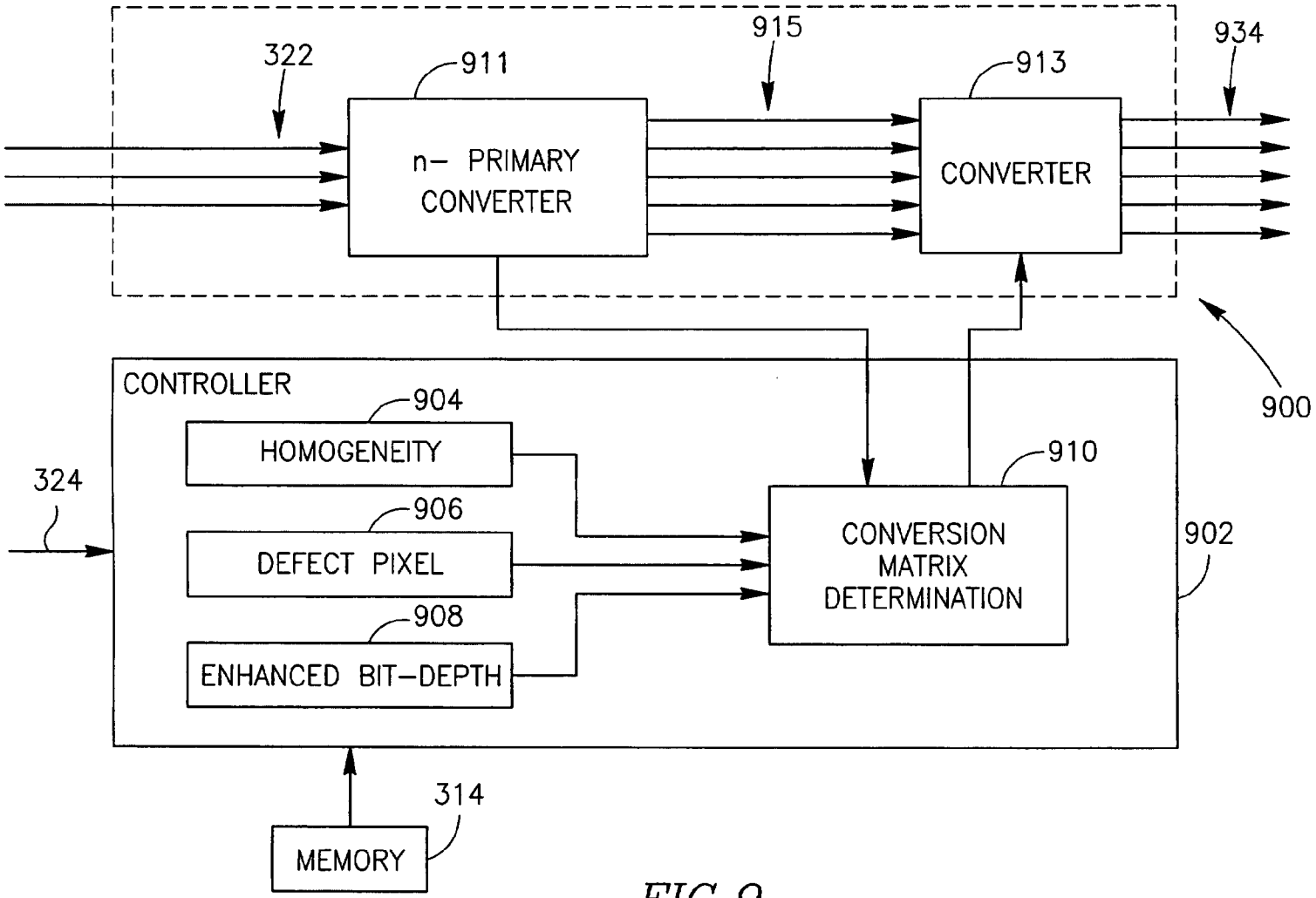
FIG. 9 is a schematic block diagram of a conversion module in accordance with another exemplary embodiment of the invention.

Reference is made to FIG. 9, which schematically illustrates a conversion module 900 according to another exemplary embodiment of the invention.

Although the invention is not limited in this respect, module 900 may perform the functionality of conversion module 304 (FIG. 3).

According to some exemplary embodiments of the invention, module 900 may include a first converter 911 to convert image data signals 322 into intermediate sub-pixel data signals 915 representing the color image in terms of at least four primary colors. For example, converter 911 may include an n-primary converter as described in Reference 3.

Module 900 may also include a second converter 913 able to convert the intermediate sub-pixel data of signals 915 into converted sub-pixel data signals 934. According to some exemplary embodiments of the invention, converter 913 may be able to perform a matrix multiplication of the intermediate sub-pixel data of signals 915 with a conversion matrix, denoted M. According to exemplary embodiments of the invention, one or more values of the conversion matrix M may be determined by a controller 902, e.g., based on signals 324, and/or one or more of the display attributes and image attributes, as described below.

According to some exemplary embodiments of the invention, controller 902 may include a homogeneity-correction module 904, a defect pixel correction module 906, an enhanced bit-depth module 908, and a matrix determination module 910. Modules 904, 906 and/or 908 may be implemented using any suitable hardware, software or combination thereof.

According to exemplary embodiments of the invention, module 904 may be adapted to determine one or more values of a homogeneity correction matrix to be applied to the data of signals 915. For example, the homogeneity correction matrix may include a diagonal homogeneity correction matrix, denoted H, e.g., including homogeneity correction values, which may be determined, e.g., based on signal 324 and/or homogeneity-correction information stored in memory 314.

Module 906 may be adapted to determine one or more correction values, denoted $P_{ij}$, of a correction matrix, denoted P, to be applied to the data of signals 915, for example, if a sub-pixel intended for reproducing the data of signals 915 is determined to be a defect sub-pixel. For example, module 906 may determine one or more correction values $P_{ij}$, for example, based on defect pixel information stored in memory 314, and signal 324, e.g., using a method analogous to the method described above with reference to FIGS. 4 and 5.

Module 908 may be adapted to determine one or more of correction values $P_{ij}$, for example, if a sub-pixel intended for reproducing the data of signals 915 is determined to be a benign sub-pixel. Module 908 may determine the correction values, e.g., based on enhanced bit-depth information stored in memory 314, and signal 324, e.g., using a method analogous to the method described above with reference to FIGS. 4 and 5.

According to exemplary embodiments of the invention, module 910 may be able to determine one or more values of the conversion matrix M, e.g., based on one or more values, e.g., including the homogeneity-correction values of matrix H and/or the correction values of matrix P, received from modules 904, 906 and/or 908. For example, module 910 may determine one or more values of the conversion matrix according to the following equation:

$$M_{ij}=H_i*f(Y)*\delta_{ij}+H_i*(1-f(Y))*P_{ij} \quad (1)$$

wherein $M_{ij}$ denotes an element in the i-th row and j-th column of the conversion matrix, $H_i$ denotes an i-th row of matrix H, Y denotes a brightness level, $f(Y)$ denotes a predetermined function of brightness level Y, and $\delta_{ij}$ denotes the Kronecker delta. For example, $f(Y)$ may have a predetermined constant value, e.g., zero, if, for example, a sub-pixel intended for reproducing the data of signals 915 is determined to be a defect sub-pixel.

Some exemplary embodiments of the invention are described herein in relation to controllably activating drivers of an array of sub-pixel elements based on image data representing a color image in terms of three primary colors. However, it will be appreciated by those skilled in the art, that other embodiments of the invention may be implemented for activating the drivers based on image data representing the color image in terms of more than three primary colors, e.g., image data representing the color image in terms of at least four primary colors.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A color display device for displaying a more-than-three color image, the device comprising a driver control module to controllably activate one or more drivers of an array of sub-pixel elements of at least four different colors based on image data representing pixels of said color image in terms of at least three data components wherein said driver control module comprises:

a conversion module for converting said image data into converted sub-pixel data representing said color image in terms of four or more primary colors said conversion module comprises:

a first converter for converting said image data into intermediate sub-pixel data of four or more primary colors, and a second converter for converting said intermediate sub-pixel data into said converted sub-pixel data using at least one conversion matrix, wherein the converted sub-pixel data depends on the intermediate sub-pixel data and a position of the pixel displaying the data, wherein data for each of said four or more primary colors of said converted sub-pixel data is in gray-level format, and a controller to control said conversion module to convert said image data into said converted sub-pixel data based on said one or more display-attributes and said one or more image-attributes, wherein said controller is able to determine one or more values of said at least one conversion matrix based on at least one display attribute related to said display device and at least one image attribute related to said color image, and to provide said values of said at least one conversion matrix to said second converter, wherein said one or more display-attributes comprise at least one attribute selected from the group consisting of a configuration of one or more defective sub-pixel elements within said array, a brightness non-homogeneity of said display device, and a color non-homogeneity of said display device.

2. The device of claim 1, wherein said conversion module comprises:

a first converter to convert the image data representing pixels of said color image in terms of at least three data components into first intermediate sub-pixel data of said four or more colors;

a second converter to convert the image data representing pixels of said color image in terms of at least three data components into second intermediate sub-pixel data of three or more colors; and a combiner to combine said first and second intermediate sub-pixel data into said converted sub-pixel data, wherein said controller is able to control at least one of said first and second converters and said combiner based on at least one of said display attributes and image attributes.

3. The device of claim 2, wherein said second converter is able to convert the image data representing pixels of said color image in terms of at least three data components using at least one conversion matrix, which is based on at least one of said display attributes and said image attributes.

4. The device of claim 1, wherein said controller is able to determine one or more values of said conversion matrix based on one or more timing signals related to said image data.

5. The device of claim 1, wherein said driver control module comprises a sub-pixel processor to process said converted sub-pixel data, wherein said controller is able to control said processor to generate a sub-pixel signal based on at least one of said image attributes and said display attributes.

6. The device of claim 5 comprising an interface module to generate driver signals based on said sub-pixel data signal.

7. The device of claim 1 comprising a memory to store display-related data representing said one or more display attributes.

8. A color display device for displaying a more-than-three color image, the device comprising a driver control module to controllably activate one or more drivers of an array of sub-pixel elements of at least four different colors based on image data representing pixels of said color image in terms of at least three data components wherein said driver control module comprises:

a conversion module for converting said image data into converted sub-pixel data representing said color image in terms of four or more primary colors said conversion module comprises:

a first converter for converting said image data into intermediate sub-pixel data of four or more primary colors, and a second converter for converting said intermediate sub-pixel data into said converted sub-pixel data using at least one conversion matrix, wherein the converted sub-pixel data depends on the intermediate sub-pixel data and a position of the pixel displaying the data, wherein data for each of said four or more primary colors of said converted sub-pixel data is in gray-level format, and a controller to control said conversion module to convert said image data into said converted sub-pixel data based on said one or more display-attributes and said one or more image-attributes, wherein said controller is able to determine one or more values of said at least one conversion matrix based on at least one display attribute related to said display device and at least one image attribute related to said color image, and to provide said values of said at least one conversion matrix to said second converter, wherein said one or more image-attributes comprise one or more attributes selected from the group consisting of a perceived bit-depth of pixels of at least part of said image, a viewed smoothness of at least part of said image, a brightness uniformity of at least part of said image, a color uniformity of at least part of said image, and a rendering scheme to be applied to at least part of said image.

9. The device of claim 1, comprising a display panel containing said driver control module and said array of sub-pixel elements.

10. The device of claim 1, wherein said array of sub-pixel elements comprises an array of liquid crystal elements.

11. A method of displaying a more-than-three color image on a display device comprising controllably activating one or more drivers of an array of sub-pixel elements of at least four different colors, based on image data representing pixels of said color image in terms of at least three data components, said one or more drivers to perform:

determining values of at least one conversion matrix based on at least one display attribute related to said display device and at least one image attribute related to said color image;

converting said image data into intermediate sub-pixel data of four or more primary colors;

using said determined values of said at least one conversion matrix to convert said intermediate sub-pixel data into converted sub-pixel data, said converted sub-pixel data representing said color image in terms of four or more primary colors, wherein data for each of said four or more primary colors of said converted sub-pixel data is in gray-level format, wherein the converted sub-pixel data depends on the intermediate sub-pixel data and a position of the pixel displaying the data; and generating one or more driver signals for activating said drivers based on one or more display attributes related to said display device and one or more image attributes related to said color image, wherein said one or more display-attributes comprise at least one attribute selected from the group consisting of a configuration of one or more defective sub-pixel elements within said array, a brightness non-homogeneity of said display device, and a color non-homogeneity of said display device.

12. The method of claim 11, wherein converting said image data comprises:

converting the image data representing pixels of said color image in terms of at least three data components into first intermediate sub-pixel data of said at least four primary colors;

converting the image data representing pixels of said color image in terms of at least three data components into second intermediate sub-pixel data of at least three primary colors;

combining said first and second intermediate sub-pixel data into said converted sub-pixel data; and controlling at least one of converting said image data into said first intermediate sub-pixel data, converting said image data into said second intermediate sub-pixel data, and said combining, based on at least one of said display attributes and said image attributes.

13. The method of claim 12, wherein converting said image data into said second intermediate sub-pixel data comprises converting said image data using at least one conversion matrix, which is based on at least one of said display attributes and said image attributes.

14. The method of claim 11 comprising determining one or more values of said conversion matrix based on one or more timing signals related to said image data.

15. The method of claim 11 comprising processing said converted sub-pixel data and generating a sub-pixel signal based on at least one of said image attributes and said display attributes.

16. The method of claim 15 comprising generating said driver signals based on said sub-pixel data signal.

17. A method of displaying a more-than-three color image on a display device comprising controllably activating one or more drivers of an array of sub-pixel elements of at least four different colors, based on image data representing pixels of said color image in terms of at least three data components, said one or more drivers to perform:

determining values of at least one conversion matrix based on at least one display attribute related to said display device and at least one image attribute related to said color image;

converting said image data into intermediate sub-pixel data of four or more primary colors;

using said determined values of said at least one conversion matrix to convert said intermediate sub-pixel data into converted sub-pixel data, said converted sub-pixel data representing said color image in terms of four or more primary colors, wherein data for each of said four or more primary colors of said converted sub-pixel data is in gray-level format, wherein the converted sub-pixel data depends on the intermediate sub-pixel data and a position of the pixel displaying the data; and generating one or more driver signals for activating said drivers based on one or more display attributes related to said display device and one or more image attributes related to said color image wherein said one or more image-attributes comprise one or more attributes selected from the group consisting of a perceived bit-depth of pixels of at least part of said image, a viewed smoothness of at least part of said image, a brightness uniformity of at least part of said image, a color uniformity of at least part of said image, and a rendering scheme to be applied to at least part of said image.

18. A color display system for displaying a more-than-three color image, the system comprising:

an input interface to generate image data signals representing pixels of said color image in terms of at least three data components; and a driver control module to controllably activate one or more drivers of an array of sub-pixel elements of at least four different colors, based on said image data signals, wherein said driver control module is able to generate one or more driver signals for activating said drivers based on one or more position-dependent display attributes independently related to individual positions in said display device and one or more image attributes related to said color image, wherein said one or more display-attributes comprise at least one attribute selected from the group consisting of a configuration of one or more defective sub-pixel elements within said array, a brightness non-homogeneity of said display device, and a color non-homogeneity of said display device.

19. The system of claim 18, wherein said driver control module comprises:

a conversion module to convert said image data signals into converted sub-pixel data signals representing said color image in terms of four or more colors; and a controller to control said conversion module to convert said image data signals based on said one or more display-attributes and said one or more image-attributes, wherein data for each of said four or more primary colors of said converted sub-pixel data is in gray-level format.

20. The system of claim 19, wherein said driver control module comprises a sub-pixel processor to process said converted sub-pixel data signals, wherein said controller is able to control said processor to generate a sub-pixel signal based on at least one of said image attributes and said display attributes.

21. A color display system for displaying a more-than-three color image, the system comprising:

an input interface to generate image data signals representing pixels of said color image in terms of at least three data components; and a driver control module to controllably activate one or more drivers of an array of sub-pixel elements of at least four different colors, based on said image data signals, wherein said driver control module is able to generate one or more driver signals for activating said drivers based on one or more position-dependent display attributes independently related to individual positions in said display device and one or more image attributes related to said color image, wherein said one or more image-attributes comprise one or more attributes selected from the group consisting of a perceived bit-depth of pixels of at least part of said image, a viewed smoothness of at least part of said image, a brightness uniformity of at least part of said image, a color uniformity of at least part of said image, and a rendering scheme to be applied to at least part of said image.

22. The system of claim 18, comprising a display panel containing said driver control module and said array of sub-pixel elements.

* * * * *